US008139992B2

(12) United States Patent
Pirwitz

(10) Patent No.: US 8,139,992 B2
(45) Date of Patent: Mar. 20, 2012

(54) APPARATUSES USEFUL FOR PRINTING AND METHODS OF TREATING MARKING MATERIAL ON MEDIA

(75) Inventor: Robert G. Pirwitz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 352 days.

(21) Appl. No.: 12/419,330

(22) Filed: Apr. 7, 2009

(65) Prior Publication Data

US 2010/0254736 A1 Oct. 7, 2010

(51) Int. Cl.
*G03G 15/20* (2006.01)

(52) U.S. Cl. ..... 399/329; 399/122; 399/320; 399/335; 399/336

(58) Field of Classification Search ..... 399/110, 399/122, 320, 328, 329, 335–337; 219/619
See application file for complete search history.

(56) References Cited

U.S. PATENT DOCUMENTS 6,564,033 B2 5/2003 Zhou et al.
7,177,578 B2 * 2/2007 Nakamura et al. ..... 399/327
7,228,082 B1 6/2007 Davidson et al.
2003/0228179 A1 12/2003 Yaomin et al.
2005/0006370 A1 1/2005 Suzumi
2005/0036809 A1 2/2005 Fukita et al.
2005/0047838 A1 * 3/2005 Uehara et al. ..... 399/329
2006/0093416 A1 * 5/2006 Watanabe et al. ..... 399/329
2008/0232871 A1 * 9/2008 Jung et al. ..... 399/329
2010/0098468 A1 * 4/2010 Lee ..... 399/329

OTHER PUBLICATIONS

Nathan E. Smith; U.S. Appl. No. 12/244,320, filed Nov. 2, 2008.

* cited by examiner

*Primary Examiner* — David Porta
*Assistant Examiner* — Jessica L Eley
(74) *Attorney, Agent, or Firm* — Ronald E. Prass, Jr.; Prass LLP

(57) ABSTRACT

Apparatuses useful for printing and methods of treating marking material on media are provided. An exemplary embodiment of an apparatus useful for printing includes a continuous belt including an inner surface and an outer surface, a first roll including a first outer surface forming a nip with the outer surface of the belt, and a radiant energy source disposed internal to the belt. The radiant energy source is adapted to emit radiant energy onto the inner surface of the belt at the nip.

18 Claims, 3 Drawing Sheets

APPARATUSES USEFUL FOR PRINTING AND METHODS OF TREATING MARKING MATERIAL ON MEDIA

BACKGROUND

Some printing apparatuses include a nip formed by a fuser belt and roll. In such apparatuses, media are fed to the nip and contacted by the fuser belt and roll to treat marking material on the media.

It would be desirable to provide apparatuses useful for printing and methods of treating marking material on media that are more energy efficient.

SUMMARY

Apparatuses useful for printing and methods of treating marking material on media are provided. An exemplary embodiment of an apparatus useful for printing comprises a continuous belt including an inner surface and an outer surface; a first roll including a first outer surface forming a nip with the outer surface of the belt; and a radiant energy source disposed internal to the belt. The radiant energy source is adapted to emit radiant energy onto the inner surface of the belt at the nip.

DRAWINGS

DETAILED DESCRIPTION

The disclosed embodiments include an apparatus useful for printing comprising a continuous belt including an inner surface and an outer surface; a first roll including a first outer surface forming a nip with the outer surface of the belt; and a radiant energy source disposed internal to the belt. The radiant energy source is adapted to emit radiant energy onto the inner surface of the belt at the nip.

The disclosed embodiments further include an apparatus useful for printing comprising a first roll including a first outer surface; a continuous belt including an inner surface and an outer surface forming a nip with the first outer surface; a second roll internal to the belt and including a second outer surface contacting the inner surface of the belt downstream from the nip; a third roll internal to the belt and including a third outer surface contacting the inner surface of the belt upstream from the nip; and at least one heat source for heating the outer surface of the belt. The belt is suspended between the first roll, second roll and third roll at the nip, and the belt exerts a spring force on the first outer surface at the nip.

The disclosed embodiments further include a method of treating marking material on media in an apparatus useful for printing comprising a first roll including a first outer surface, a continuous belt including an inner surface and an outer surface forming a nip with the first outer surface, a second roll internal to the belt and including a second outer surface contacting the inner surface of the belt downstream from the nip, a third roll internal to the belt and including a third outer surface contacting the inner surface of the belt upstream from the nip, wherein the belt is suspended between the first roll, second roll and third roll at the nip, and at least one heat source for heating the outer surface of the belt. The method comprises heating the outer surface of the belt with the at least one heat source; and feeding a medium including a surface and marking material on the surface to the nip; and contacting the surface of the medium and the marking material with the outer surface of the belt at the nip. The belt exerts a spring force on the medium and marking material at the nip.

As used herein, the term "apparatus useful for printing" encompasses any apparatus, such as a digital copier/printer, bookmaking machine, multifunction machine, and the like, or portions of such apparatuses, that can perform a print outputting function for any purpose. The apparatuses can use various types of solid and liquid marking materials, and various process conditions to treat the marking material and form images on media.

Figure 1:
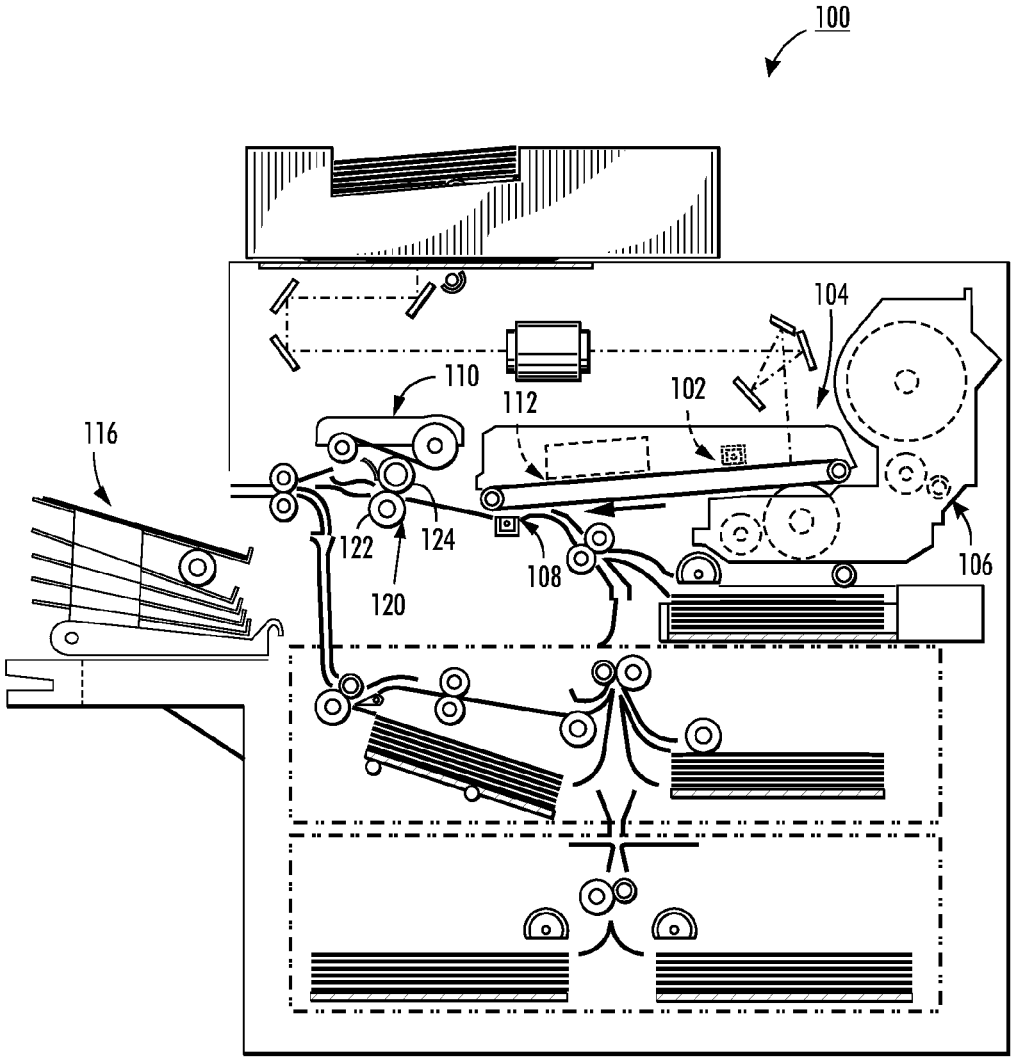
FIG. 1 RELATED ART
FIG. 1 depicts an exemplary embodiment of a printing apparatus.

FIG. 1 illustrates an exemplary printing apparatus 100, as disclosed in U.S. Pat. No. 6,265,694, which is incorporated herein by reference in its entirety. The printing apparatus 100 includes a charging station 102, an imaging/exposing station 104, a development station 106, a transfer station 108, a fusing station 110, a cleaning station 112, and a finishing station 116. The fusing station 110 includes a fusing apparatus 120 having fusing rolls 122, 124. The fusing apparatus 110 operates to heat, fuse and fix marking material onto media.

Figure 2:
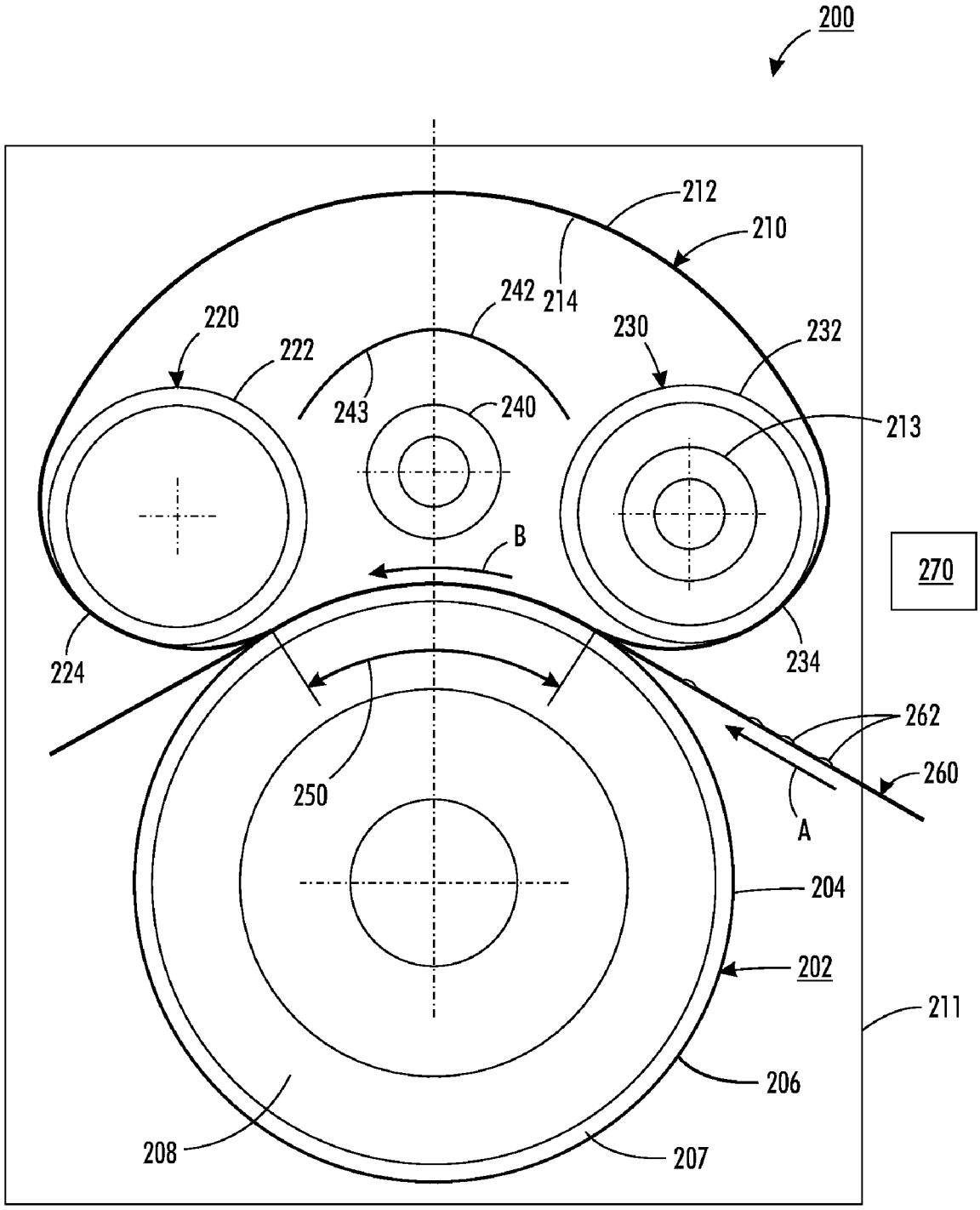
FIG. 2 depicts an exemplary embodiment of a fuser including a heat source located inside of a fuser belt.

FIG. 2 illustrates an exemplary embodiment of the apparatuses useful for printing. The illustrated apparatus is a fuser 200. Embodiments of the fuser 200 can be used in different types of printing apparatuses, such as in place of the fusing apparatus 110 in the printing apparatus 100 shown in FIG. 1.

As shown in FIG. 2, the fuser 200 includes a pressure roll 202 and a fuser belt 210. In embodiments, the pressure roll 202 includes an outer layer 206, an inner layer 207, and a core 208. The core 208 can be a thin-walled, hollow tube comprised of a metallic material having sufficient thermal conductivity to achieve temperature uniformity over the outer surface 204 of pressure roll 202 during operation of the fuser 200. For example, the core 208 can be comprised of a lightweight metal, such as aluminum, an aluminum alloy, or the like. The outer layer 206 can be comprised of a fluoropolymer having low-friction properties, such as polytetrafluoroethylene, or the like. The inner layer 207 between the outer layer 206 and core 208 can be comprised of silicone rubber, or the like.

In embodiments, the inner layer 207 and outer layer 206 are relatively thin, and the core 208 acts as a heat equalizer across the paper path on the outer surface 204 of the pressure roll 202. The pressure roll 202 can have a low thermal mass effective to reduce temperature droop of the fuser belt 210 after a first print is made in the fuser 200. By reducing temperature droop, the amount of cooling of the fuser belt 210 caused by contact with the pressure roll 202 is reduced, thereby allowing the temperature of fuser 200 to stabilize more quickly. Consequently, the quality of images produced on media can be improved in the fuser 200.

In embodiments, the pressure roll 202 can be mounted in a fixed position in a frame 211. The pressure roll 202 is driven to rotate by a mechanism including a motor (not shown) operatively coupled to the pressure roll 202.

In embodiments, the pressure roll 202 may or may not include an internal heat source for heating the outer surface 204.

The fuser belt 210 includes an outer surface 212 and an inner surface 214. A first internal roll 220 includes an outer surface 222 contacting the inner surface 214 at a first region 224 of the fuser belt 210, and a second internal roll 230 includes an outer surface 232 contacting the inner surface 214 at a second region 234 of fuser belt 210. In embodiments, the first internal roll 220 and second internal roll 230 can be mounted in fixed positions to the frame 211. In the orientation of the fuser 200 shown in FIG. 2, the centers of the first internal roll 220 and second internal roll 230 are spaced horizontally from the center of the pressure roll 202, and the pressure roll 202 is positioned below the fuser belt 210.

In other embodiments, the first internal roll 220 and second internal roll 230 can be movably positioned in contact with the pressure roll 202. For example, one or both of the first internal roll 220 and second internal roll 230 can be resiliently biased by a spring loading mechanism against the pressure roll 202.

The fuser belt 210 is driven to rotate clockwise as indicated by arrow B by contact with the outer surface 204 of pressure roll 202 and with a medium 260 moving in process direction A. The first internal roll 220 and second internal roll 230 can be driven to rotate solely by contact with the rotating fuser belt 210. In other embodiments, the first internal roll 220 and second internal roll 230 can be driven by a drive mechanism (not shown).

In embodiments, the first internal roll 220 and second internal roll 230 can have a low-mass construction. The first internal roll 220 and second internal roll 230 can comprise a light-weight metal, such as aluminum, an aluminum alloy, or the like. The first internal roll 220 and second internal roll 230 can have a small outer diameter and thin wall to decrease their thermal mass, and also decrease the amount surface area contact between the outer surfaces 222, 232 and the inner surface 214 of the fuser belt 210, which can reduce heat transfer and associated cooling of the fuser belt 210. The outer surfaces 222, 232 can have a smooth finish to reduce friction between these surfaces and the inner surface 214 of fuser belt 210. A low-friction material, such as polytetrafluoroethylene, or the like, can be applied on the outer surfaces 222, 232 to further reduce this friction. In embodiments, the material applied on the outer surfaces 222, 232 can have a low thermal conductivity to reduce heat loss from the fuser belt 210 to the first internal roll 220 and second internal roll 230.

In other embodiments, the first internal roll 220 and/or second internal roll 230 can also function as heat equalizing rolls and/or heat rolls. As shown, the second internal roll 230 can include an internal heat source 213 adapted to heat the outer surface 232 in contact with the fuser belt 210. The heat source 213 heats the fuser belt 210 before it is rotated to contact the pressure roll 202. The heat source 213 can be one or more axially-extending lamps, or the like. A heat source can optionally also be provided in the first internal roll 220 to heat the fuser belt 210.

The fuser belt 210 typically has a circular shape when in its non-deformed condition. The fuser belt 210 is elastically deformed when it is installed on the first internal roll 220 and second internal roll 230, as shown. The fuser belt 210 is held in intimate contact with the pressure roll 202 by the first internal roll 220 and second internal roll 230. The outer surface 212 of the fuser belt 210 contacts the outer surface 204 of the pressure roll 202 to form a nip 250. As shown, the outer surface 212 of fuser belt 210 is concave at the nip 250 and conforms to the shape of the outer surface 204 of pressure roll 202.

The fuser belt 210 substantially is not loaded in tension when positioned on the first internal roll 220 and second internal roll 230 in the configuration shown in FIG. 2. This configuration reduces, and desirably minimizes, axial loads in the fuser 200. Such axial loads produced by tensioned belts can significantly reduce the service life of belts.

In the fuser 200, the section of the fuser belt 210 located at the nip 250 is suspended between the first internal roll 220, second internal roll 230 and pressure roll 202. The fuser belt 210 functions as a spring and can produce a sufficient nip load for treating marking material on media without using a separate loading mechanism (such as a spring loading mechanism attached to the pressure roll 202) to produce the nip load. This feature simplifies the construction of the fuser 200. The thickness of the fuser belt 210 and its elastic properties can be selected to affect the load exerted by the fuser belt 210 at nip 250.

In embodiments, the fuser belt 210 is comprised of a metal with a composition and thickness effective to provide sufficient flexibility and produce a sufficient spring load at the nip 250. The metal can be an alloy, such as a spring-grade stainless steel, or the like. The metal can typically have a thickness of about 0.2 mm to about 1 mm, such as about 0.3 mm to about 0.6 mm, to provide its desired functions in the fuser 200.

The outer surface of the metal of the fuser belt 210 can be coated with a polymer having suitable thermal conductivity and elasticity, such as a silicone rubber, or the like. The fuser belt 210 can also include an outer layer overlying the polymer and forming the outer surface 212. The outer layer can be comprised of a polymer having low-friction properties, such as polytetrafluoroethylene, or the like, to reduce adherence of media and marking material to the outer surface 212.

In embodiments, the nip 250 is relatively wide. For example, when the pressure roll 202 has an outer diameter of about 30 mm to about 40 mm, the nip 250 can have a width measured about the circumference of the outer surface 204 of the pressure roll 202 between the inlet and the outlet of the nip 250 of about 8 mm to about 20 mm. In the illustrated orientation of fuser 200, the positions of the first internal roll 220 and second internal roll 230 can be moved downward to increase the width of nip 250, or moved upward to decrease the width of nip 250.

The fuser 200 further includes a heat lamp 240 located internal to the fuser belt 210. The heat lamp 240 emits radiant energy to heat the section of the fuser belt 210 at the nip 250. The radiant energy impinges on the inner surface 214 of the fuser belt 210 substantially at the nip 250. In embodiments, the radiant energy source can include one or more heat lamps, such as (tungsten-quartz) heat lamp 240, which extend axially inside of the fuser belt 210. Such lamps can be mounted in fixed positions in the frame 211. In embodiments, a power supply 270 is connected to the heat lamp 240 and internal heat source 213 in a conventional manner.

The heat lamps 240 can emit sufficient radiant energy to heat the section of the fuser belt 210 at nip 250 to a temperature effective to treat marking material on media. For example, the outer surface 212 of fuser belt 210 can be heated to a temperature of about 150° C. to about 210° C. using the heat lamp 240. A reflector 242 having a concave surface 243 facing the inner surface 214 at the nip 250 reflects radiant energy emitted by the heat lamp 240 onto the inner surface 214 at nip 250. In embodiments, the heat lamp 240 can be mounted close to the nip 250.

In embodiments, concentrating thermal energy emitted by the heat lamp 240 in the region of nip 250, in combination with the use of a low-mass first internal roll 220, second internal roll 230 and pressure roll 202, and optionally providing an internal heat source in the first internal roll 220 and/or second internal roll 230, can reduce first copy out time and improve energy and process efficiency in fuser 200.

In embodiments, axial movement of the fuser belt 210 is reduced by having low-friction contact between the first internal roll 220 and second internal roll 230 and the inner surface 214, and between the outer surface 212 of fuser belt 210 and the outer surface 204 of pressure roll 202. Such axial movement can damage fuser belts and can cause stalling to occur in fusers. End guides (not shown) can be attached to the frame 211, or provided on the axial ends of the first internal roll 220 and second internal roll 230, to counteract limited axial movement of the fuser belt 210. The end guides can be plates arranged perpendicular to the axial directions of the first internal roll 220 and second internal roll 230, for example.

FIG. 2 shows the medium 260 with marking material 262, e.g., toner, on a surface facing the outer surface 212 of fuser belt 210 moving through the nip 250 in the process direction A. The medium 260 and marking material 262 contact the outer surface 212 as the medium 260 moves through the nip 250. The dwell time is the amount of time that the medium 260 contacts the outer surface 212 during movement through the nip 250. The dwell time is a function of the speed of the medium in the process direction A and the width of the nip 250. By increasing the width of nip 250, at any given media speed, the dwell time is increased in fuser 200. By increasing the dwell time, the medium 260 can be heated for a longer period of time as it passes through the nip 250, as compared to a narrower nip. By increasing the dwell time in the fuser 200, the temperature to which media are heated at the nip 250 can be decreased, while still supplying a sufficient total amount of thermal energy to the media to treat marking material on the media passing through the nip 250. Consequently, the service life of the fuser belt 210 can be increased by subjecting it to lower temperatures during operation.

In other embodiments, the components of the fuser 200 can be arranged in different orientations than the orientation shown in FIG. 2. For example, the orientation of the fuser shown in FIG. 2 can be rotated 180° to position the pressure roll 202 above the fuser belt 210.

Figure 3:
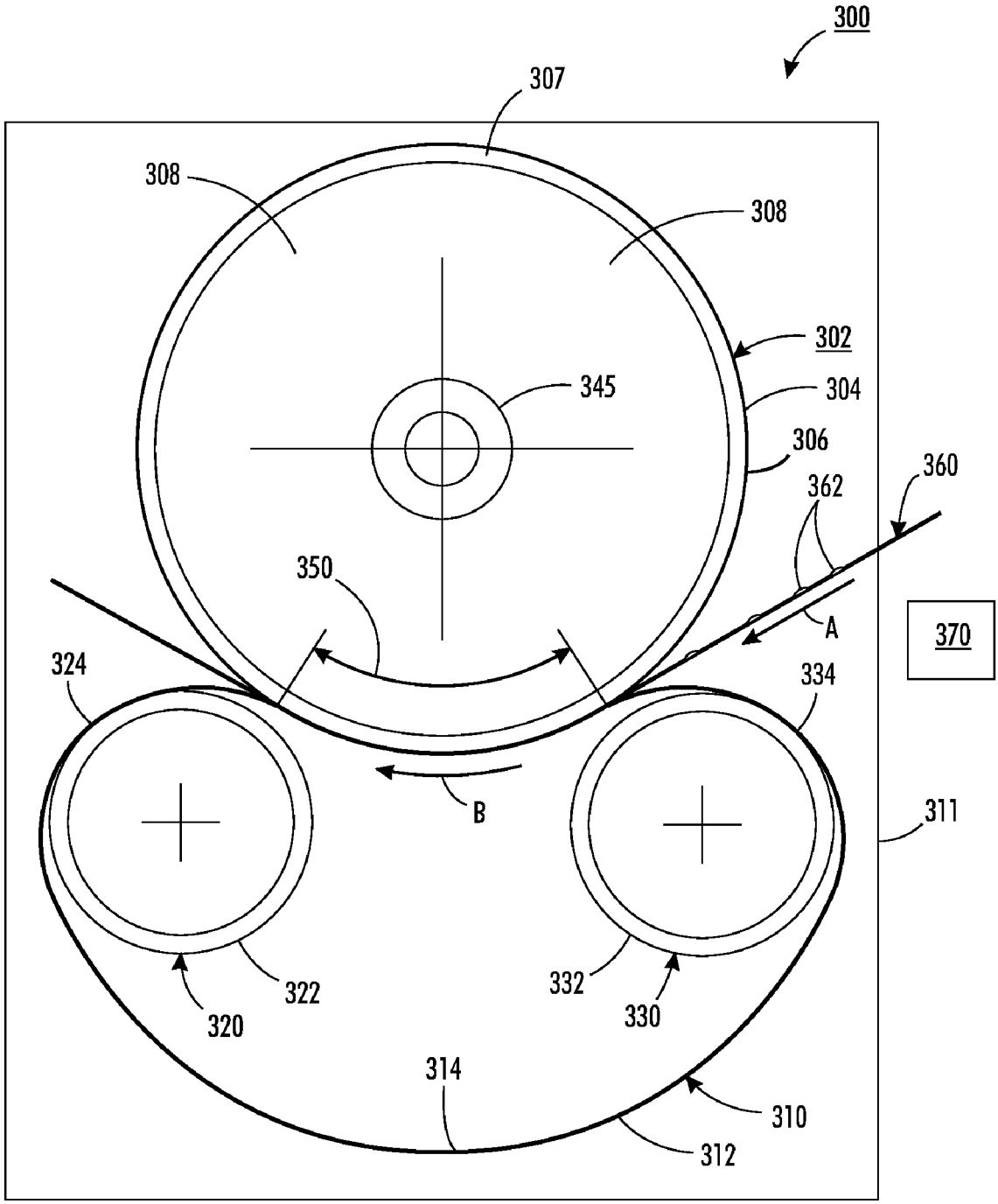
FIG. 3 depicts another exemplary embodiment of a fuser including a heat source located inside of a fuser roll.

FIG. 3 depicts another exemplary embodiment of an apparatus useful for printing. The apparatus is a fuser 300. Embodiments of the fuser 300 can be used in different types of printing apparatuses, such as to replace the fusing apparatus 110 in the printing apparatus 100 shown in FIG. 1.

As shown in FIG. 3, the fuser 300 includes a fuser roll 302 and a pressure belt 310. In embodiments, the fuser roll 302 includes an outer layer 306, inner layer 307, and a core 308. The core 308 can have the same thin-walled, hollow tube construction and be comprised of the same metallic materials as the core 208 of the pressure roll 202, for example. The outer layer 306 can be comprised of a fluoropolymer having low friction properties, such as polytetrafluoroethylene, or the like. The inner layer 307 can be comprised of silicone rubber, or the like. In embodiments, the inner layer 307 and outer layer 306 are relatively thin, and the core 308 acts as a heat equalizer across the paper path on the outer surface 304 of fuser roll 302. In embodiments, the fuser roll 302 has a low thermal mass effective to reduce temperature droop of the pressure belt 310 after a first print is made in the fuser 300, and allow the temperature of fuser 300 to stabilize more quickly.

In embodiments, the fuser roll 302 can be mounted in a fixed position in a frame 311. The fuser roll 302 is driven to rotate by a mechanism including a motor (not shown) operatively coupled to the fuser roll 302.

The pressure belt 310 includes an outer surface 312 and an inner surface 314. A first internal roll 320 includes an outer surface 322 contacting the inner surface 314 at a first region 324 of pressure belt 310, and a second internal roll 330 includes an outer surface 332 contacting the inner surface 314 at a second region 334 of pressure belt 310. In the illustrated orientation of the fuser 300, the centers of the first internal roll 320 and second internal roll 330 are horizontally spaced from the center of the fuser roll 302, and the fuser roll 302 is positioned above the pressure belt 310.

In other embodiments, one or both of the first internal roll 320 and second internal roll 330 can be movably positioned in contact with the fuser roll 302 via a spring loading mechanism, or the like.

In embodiments, the first internal roll 320 and second internal roll 330 can be mounted in fixed positions to the frame 311. The pressure belt 310 is driven to rotate clockwise as indicated by arrow B by contact with the outer surface 304 of the fuser roll 302 and the medium 360. The first internal roll 320 and second internal roll 330 can be driven to rotate solely by contact with the rotating pressure belt 310. In other embodiments, the first internal roll 320 and second internal roll 330 can be driven by a drive mechanism.

In embodiments, the first internal roll 320 and second internal roll 330 have a low-mass construction. For example, first internal roll 320 and second internal roll 330 can have the same construction as the first internal roll 220 and second internal roll 230, respectively, of fuser 200. The outer surfaces 322, 332 of the first internal roll 320 and second internal roll 330, respectively, can have a smooth finish to reduce friction between these surfaces and the inner surface 314 of pressure belt 310. A low-friction material can be applied on the outer surfaces 322, 332. The material applied on the outer surfaces 322, 332 can have a low thermal conductivity to reduce heat loss from the pressure belt 310 to the first internal roll 320 and second internal roll 330.

In embodiments, the first internal roll 320 and/or second internal roll 330 can function as heat equalizing rolls and/or heat rolls. For example, the first internal roll 320 and/or second internal roll 330 can include an internal heat source for heating the outer surface 322 and/or outer surface 332 to supply thermal energy to the pressure belt 310. For example, the heat source(s) can be one or more axially-extending lamps, or the like.

In other embodiments, a heat source can be provided internally of the pressure belt 310. In such embodiments, the outer surface 312 is heated by contact with the heated outer surface 304 of the fuser roll 302.

As shown, the pressure belt 310 is elastically deformed when installed on the first internal roll 320 and second internal roll 330, and is held in intimate contact with the fuser roll 302 by the first internal roll 320 and second internal roll 330. The outer surface 312 of the pressure belt 310 contacts the outer surface 304 of the fuser roll 302 to form a nip 350. As shown, the outer surface 312 of pressure belt 310 is concave at the nip 350 and conforms to the shape of the outer surface 304 of fuser roll 302.

The pressure belt 310 substantially is not loaded in tension when installed on the first internal roll 320 and second internal roll 330 in the configuration shown in FIG. 3. This configuration reduces, and desirably minimizes, axial loads in the fuser 300. In the fuser 300, the section of the pressure belt 310 located at nip 350 is suspended between the first internal roll 320, second internal roll 330 and fuser roll 302. The pressure belt 310 functions as a spring to produce a sufficient nip load for treating marking material on media without using a separate loading mechanism to produce a nip load.

In embodiments, the pressure belt 310 can have the same composition and thickness as that of fuser belt 210. The outer surface of the metal of the pressure belt 310 can be coated with a polymer having suitable thermal conductivity and elasticity, such as a silicone rubber, or the like. The pressure belt 310 can also include an outer layer overlying the polymer and forming the outer surface 312. The outer layer can be comprised of a polymer having low-friction properties.

In embodiments, the nip 350 is relatively wide. For example, when the fuser roll 302 has an outer diameter of about 30 mm to about 40 mm, the nip 350 can have a width measured about the circumference of the outer surface 304 of the fuser roll 302 between the inlet and the outlet of the nip 350 of about 8 mm to about 20 mm. In the illustrated orientation of fuser 300, the positions of the first internal roll 320 and second internal roll 330 can be moved vertically upward to increase the width of nip 350, and vertically downward to decrease the width of nip 350.

The fuser 300 further includes a heat source 345 located internal to the fuser roll 302. The heat source 345 heats the outer surface 304. In embodiments, the heat source 345 can include one or more lamps, such as tungsten-quartz lamps, which extend axially inside the fuser roll 302. Such lamps can be mounted in fixed positions in the frame 311. In embodiments, a power supply 370 is connected to the heat source 345 in a conventional manner.

The heat source 345 can supply sufficient thermal energy to heat the outer surface 312 of the pressure belt 310 to a temperature effective to treat marking material on media at nip 350. For example, the outer surface 312 of pressure belt 310 can be heated to a temperature of about 150° C. to about 210° C. using the heat source 345.

In embodiments, using a low-mass first internal roll 320, second internal roll 330 and fuser roll 302, and optionally an internal heat source in the first internal roll 320 and/or second internal roll 330, can reduce first copy out time and improve process efficiency in fuser 300.

In embodiments, axial movement of the pressure belt 310 is reduced by having low-friction contact between each of the first internal roll 320 and second internal roll 330 and the inner surface 314, and between the outer surface 312 of pressure belt 310 and the outer surface 304 of fuser roll 302. End guides (not shown) can be attached to the frame 311, or be provided on the axial ends of the first internal roll 320 and second internal roll 330, to counteract limited axial movement of the pressure belt 310.

FIG. 3 shows a medium 360 with marking material 362, e.g., toner, on a surface facing the outer surface 304 of fuser roll 302. The medium 360 and marking material 362 contacts the outer surface 304 as the medium 360 moves through the nip 350 in the process direction A. By increasing the nip width, the dwell time is increased in fuser 300. By increasing the dwell time, the pressure belt 310 can be subjected to lower temperatures.

In other embodiments, the components of the fuser 300 can be arranged in different orientations than the orientation shown in FIG. 3. For example, the orientation of the fuser shown in FIG. 3 can be rotated 180° to position the fuser roll 302 below the pressure belt 310.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a continuous belt including an inner surface and an outer surface;

a first roll including a first outer surface forming a nip with the outer surface of the belt; and a radiant energy source disposed internal to the belt, the radiant energy source adapted to emit radiant energy onto the inner surface of the belt at the nip; and a second roll internal to the belt and including a second outer surface contacting the inner surface of the belt upstream from the nip, wherein at least one of the first roll and the second roll includes an internal heat source configured to heat the belt.

2. The apparatus of claim 1, further comprising:

a third roll internal to the belt and including a third outer surface contacting the inner surface of the belt downstream from the nip.

3. The apparatus of claim 2, wherein the belt is suspended between the first roll, second roll and third roll at the nip, and the belt exerts a spring force on the first outer surface at the nip.

4. The apparatus of claim 1, wherein the belt is comprised of a metal including the inner surface, and a polymer overlying the metal forming the outer surface.

5. The apparatus of claim 1, further comprising a reflector disposed internal to the belt for reflecting radiant energy emitted by the radiant energy source onto the inner surface of the belt at the nip.

6. The apparatus of claim 1, wherein the radiant heat source comprises at least one lamp extending axially along the belt.

7. The apparatus of claim 1, wherein:

at the nip, the outer surface of the belt is concave and conforms to the shape of the first outer surface; and the nip has a width about a circumference of the first outer surface of about 8 mm to about 20 mm from an inlet at which media enter the nip to an outlet at which media exit the nip.

8. The apparatus of claim 1, wherein the first roll includes an internal heat source for heating the first outer surface.

9. The apparatus of claim 1, comprising:

a reflector disposed internal to the belt for reflecting radiant energy emitted by the radiant energy source onto the inner surface of the belt at an entrance of the nip and at an exit of the nip.

10. An apparatus useful for printing, comprising:

a first roll including a first outer surface;

a continuous belt including an inner surface and an outer surface forming a nip with the first outer surface;

a second roll internal to the belt and including a second outer surface contacting the inner surface of the belt downstream from the nip;

a third roll internal to the belt and including a third outer surface contacting the inner surface of the belt upstream from the nip;

a first heat source disposed internal to the belt for heating the outer surface of the belt; and a second heat source, the second heat source being one of a heat source disposed internal to the first roll for heating the first outer surface, and a heat source disposed internal to the third roll for heating the third outer surface;

wherein the belt is suspended between the first roll, second roll and third roll at the nip, and the belt exerts a spring force on the first outer surface at the nip.

11. The apparatus of claim 10, wherein the at least one heat source is disposed internal to the first roll for heating the first outer surface.

12. The apparatus of claim 10, wherein the belt is comprised of a metal including the inner surface, and a polymer on the metal forming the outer surface.

13. The apparatus of claim 10, wherein:

at the nip, the outer surface of the belt is concave and conforms to the shape of the first outer surface; and the nip has a width about a circumference of the first outer surface of about 8 mm to about 20 mm from an inlet at which media enter the nip to an outlet at which media exit the nip.

14. A method of treating marking material on media in an apparatus useful for printing comprising a first roll including a first outer surface, a continuous belt including an inner surface and an outer surface forming a nip with the first outer surface, a second roll internal to the belt and including a second outer surface contacting the inner surface of the belt downstream from the nip, a third roll internal to the belt and including a third outer surface contacting the inner surface of the belt upstream from the nip, wherein the belt is suspended between the first roll, second roll and third roll at the nip, and at least one heat source for heating the outer surface of the belt, the method comprising:

heating the outer surface of the belt with a plurality of heat sources;

feeding a medium including a surface and marking material on the surface to the nip; and contacting the surface of the medium and the marking material with the outer surface of the belt at the nip;

wherein the belt exerts a spring force on the medium and marking material at the nip, wherein the plurality of heat sources comprises a radiant energy source disposed internal to the belt, the radiant energy source being configured to emit radiant energy onto the inner surface of the belt at the nip, and wherein the plurality of heat sources comprises at least one of a heat source disposed internal to the third roll and a heat source disposed internal to the first roll.

15. The method of claim 14, wherein the plurality of heat sources comprises the heat source disposed internal to the third roll for heating the belt upstream of the nip.

16. The method of claim 14, wherein the plurality of heat sources comprises the heat source disposed internal to the first roll for heating the outer surface of the belt.

17. The method of claim 14, wherein the belt is comprised of a metal including the inner surface, and a polymer on the metal forming the outer surface.

18. The method of claim 14, wherein:

at the nip, the outer surface of the belt is concave at the nip and conforms to the shape of the first outer surface; and the nip has a width about a circumference of the first outer surface of about 8 mm to about 20 mm from an inlet at which media enter the nip to an outlet at which media exit the nip.

* * * * *